US005136731A

United States Patent [19]

Caro et al.

[11] Patent Number: 5,136,731

[45] Date of Patent: Aug. 11, 1992

[54] TOILET SEAT ADAPTOR

[76] Inventors: Dolly Caro; Arlene Siegel, both of 3 Darien Pl., East Northport, N.Y. 11731

[21] Appl. No.: 722,498

[22] Filed: Jun. 19, 1991

Related U.S. Application Data

[63] Continuation-in-part of Ser. No. 533,078, Jun. 4, 1990, abandoned.

[51] Int. Cl.[5] ..... A47K 13/06

[52] U.S. Cl. ..... 4/239; 4/245.3; 4/245.4

[58] Field of Search ..... 4/235, 239, 242, 248

[56] References Cited

U.S. PATENT DOCUMENTS

| | | | |
|---|---|---|---|
| 396,803 | 1/1889 | Breher | 4/239 |
| 496,536 | 5/1893 | Prins | 4/239 |
| 863,518 | 8/1907 | Dwyer et al. | 4/239 |
| 962,490 | 6/1910 | Bruder | 4/248 |
| 1,190,310 | 7/1916 | Long | 4/248 |
| 2,050,472 | 8/1936 | Steadman | 4/248 X |
| 2,094,498 | 9/1937 | Saunders | 4/239 |
| 3,364,505 | 1/1968 | Palmier | 4/239 |
| 3,490,082 | 1/1970 | Murcott | 4/239 |
| 4,747,167 | 5/1988 | Adams | 4/235 X |

FOREIGN PATENT DOCUMENTS

| | | | |
|---|---|---|---|
| 11692 | of 1899 | United Kingdom | 4/239 |
| 640815 | 7/1950 | United Kingdom | 4/248 |

*Primary Examiner*—Henry J. Recla
*Assistant Examiner*—Robert M. Fetsuga
*Attorney, Agent, or Firm*—Alfred M. Walker

[57] ABSTRACT

A toilet seat adaptor for the use of infants and children having two side panels in a U-shaped configuration joined together by a common hinge and separated from a toilet bowl upper rim surface by a plurality of U-shaped elevated contact members having disposable covers over outer portions of the contact members which contact the toilet bowl when the adaptor is positioned on the rim. The adaptor is foldable and minimizes surface contact thereby protecting the user from bacterial and/or viral infestation. Several embodiments of the contact members are disclosed.

2 Claims, 3 Drawing Sheets fig. 1
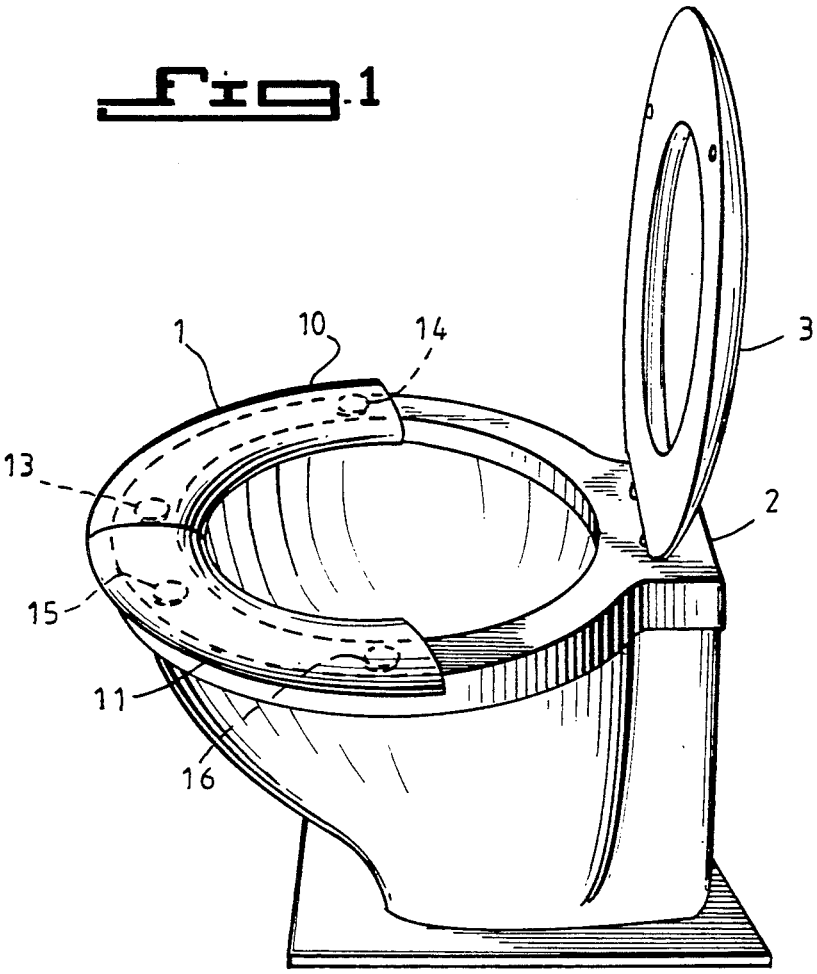
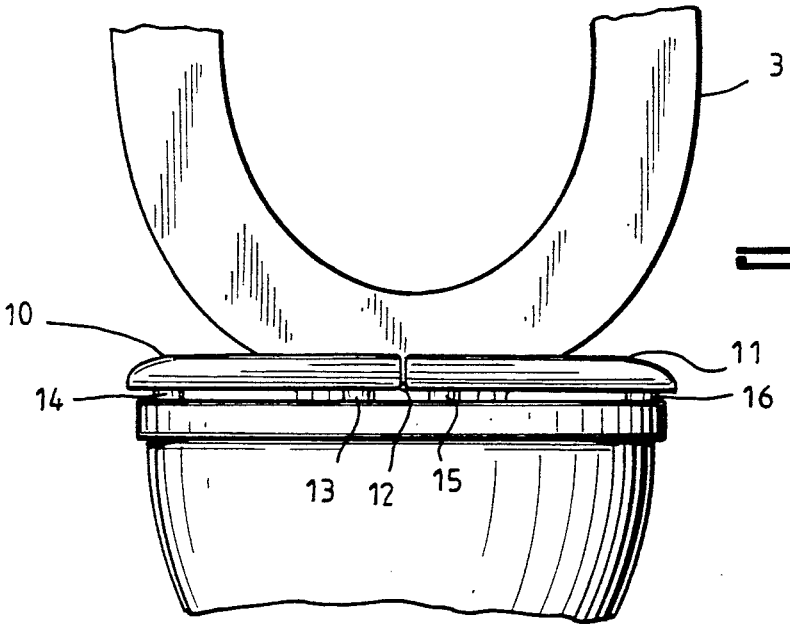
fig. 2

Fig. 3
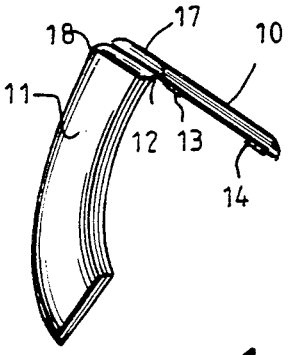
Fig. 5
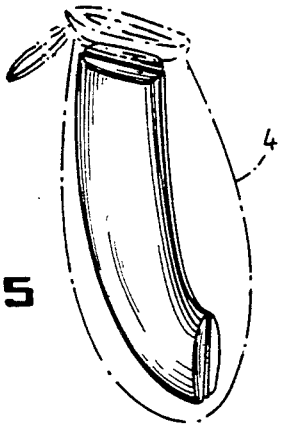
Fig. 4
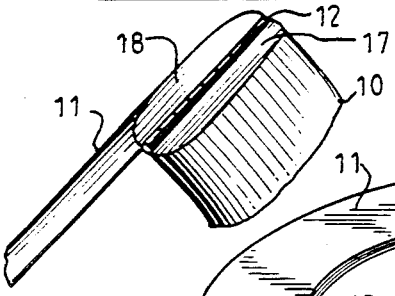
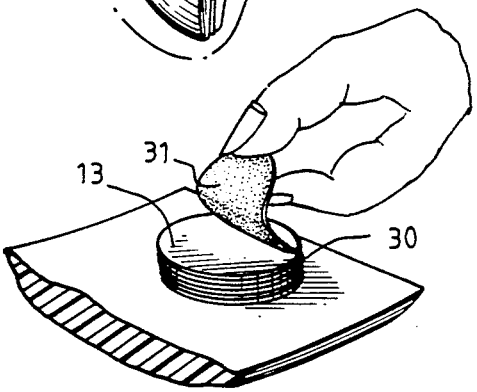
Fig. 6
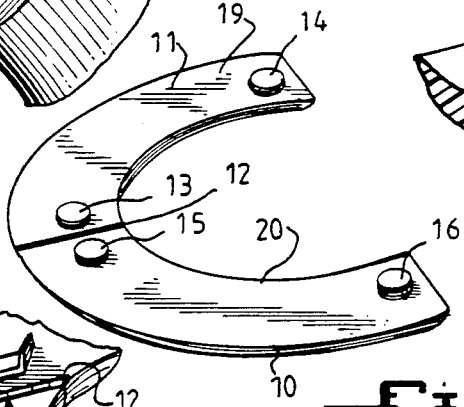
Fig. 7
Fig. 7A
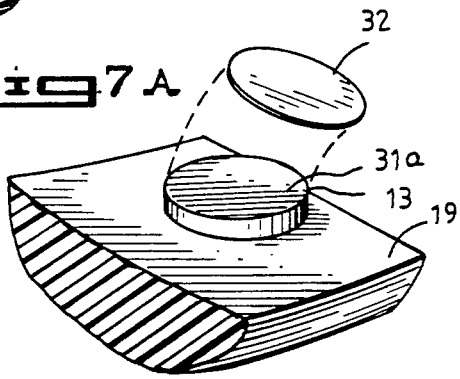
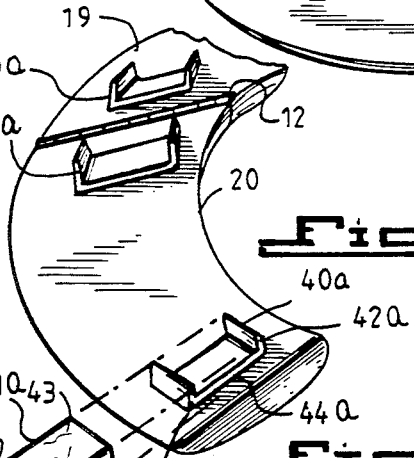
Fig. 8
Fig. 9
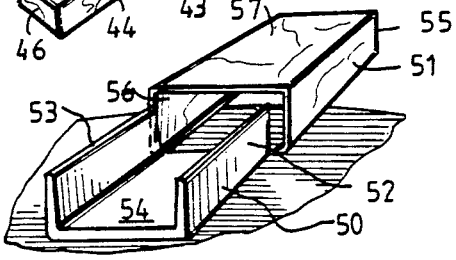
Fig. 10
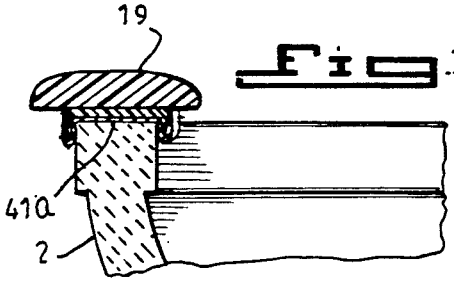

TOILET SEAT ADAPTOR

This application is a continuation-in-part of application serial number 07/533,078 filed June 4, 1990, now abandoned.

FIELD OF THE INVENTION

The present invention relates to a toilet seat adaptor for use by children. In particular, the present invention relates to the portability and sanitariness of the adaptor.

PRIOR ART

Apparatus' used as portable toilet seat adaptors are known in the art. The use of a toilet seat adaptor for the use of infants and children are disclosed in U.S. Pat. Nos. 396,803 of Breher, 969,144 of Stephan, 1,009,838 of Handy, 1,111,037 of Smith et al, 1,484,059 of Burk, 1,720,129 of Kinnard, 1,950,016 of Zuckerman, 2,050,472 of Steadman, 2,094,498 of Saunders, 2,221,991 of Myers et al, 2,676,331 of Inman and British patent 11,692 of Walchner et al. Of these patents, Breher, Kinnard, Zuckerman, Saunders, Myers, Inman and Walchner disclose temporary seats placed upon the toilet bowl top edge or the permanent seat. Only Walchner discloses a temporary seat with an elevating knob members, permanently shod with rubber or other permanent covering. However Walchner does not disclose an elevating contact member with a disposable, non-permanent surface cover between the toilet bowl edge and the elevating contact member of the toilet bowl temporary seat. Furthermore, none of the patents disclose an elevating contact member, having a disposable cover, which elevating contact members stabilizes the temporary seat upon the edge of the toilet bowl by pairs of descending arm portions to wrap around the top edge and upper sides of the toilet bowl. That is, none of the current art in toilet seat adaptors comes equipped with a means to provide for a disposable surface cover to minimize the surface contact of the toilet seat adaptor upon the toilet bowl while stabilizing the seat upon the bowl.

OBJECTS OF THE INVENTION

It is an object of the invention to provide an improved portable toilet seat for children in which the invention is easy to carry.

It is a further object to provide an improved toilet seat adaptor for children in order to minimize surface contact with the toilet bowl.

It is a still further object of this toilet seat adaptor for children to provide stability of the seat while it rests upon the bowl.

It is a further object of this invention to provide a toilet seat adaptor which is easier, more efficient and more sanitary to clean, than prior art.

It is a final object of this invention to provide for a disposable contact means between the adaptor and the bowl in order to minimize the transmission of bacterial and/or viral infection.

SUMMARY OF THE INVENTION

The present invention overcomes the disadvantages of the prior art toilet seat adaptors pointed out above by providing for the minimization of surface contact with the toilet seat. Public use facilities such as supermarkets, restaurants, gasoline stations, and the like, are frequently known to maintain unsanitary facilities for the general public. In particular, bathroom accommodations in such facilities are known to be areas of major bacterial and viral infection. The present art does not sufficiently protect infants and children from contact with these bacterial and viral infestations. The present invention provides a means whereby its surface can be cleaned in an expeditious, efficient and thorough manner without endangering the health of the user.

The toilet seat adaptor includes two curved side panels pivotable upon each other about a joining means. The curved panels are fitted with a plurality of contact members elevating the panels from the surface of the toilet bowl.

Furthermore, the elevating contact members themselves are fitted with disposable surface covers which are removed from the elevating contact means upon usage. This minimizes surface contact between the panels and the surface of the toilet bowl and minimizes the transmission of disease. The elevating contact members are isolated from the surface by the disposable surface covers.

In the preferred embodiment, the elevated contact members are inverse U shaped in profile, so that each contact member contains a pair of descending wall members, which wall members descend downward from a base portion attached to the bottom underside of the toilet seat adaptor. The descending wall members therefore provide a stabilizing means by extending respectively over each edge of the outside and inside edges of the porcelain toilet bowl.

The seat portion of the toilet seat adaptor includes the two panels, also in an inverted U configuration. The panels terminate at the hinge means creating a parallel mirror image of each other. After removal from the surface of the toilet bowl, the panels are folded at the hinge means and may be placed into a container carrier for readied use at another time in another location.

The elevating contact members are located at the front and rear of each panel and they elevate the seat in a stable position when in use in an up position. The two panels are connected by a hinge member which serves to space the two panels and provides a pivot about which they move. Each panel pivots out from its proximal end at the hinge means toward its distal end in an arcuate manner so that when unfolded it results in an inverted U configuration. The pivoting permits easy storage of the adaptor in the carrier means.

The elevating contact members are capped by disposable surface covers which can be of several types. The first type are disposable disks, either of plastic or paper, which are peeled away from the upper surface of the contact members upon each use. The second type includes a multiplicity of disks, where the disks are placed upon the surface of the elevating contact members after being removed from an external cylindrical supply of disposable disks to be placed upon the elevating contact members.

A third means includes compressible, disposable three dimensional surface cover members, which are removably attached to and compressibly conformable to the insides of each contact member, which contact members each have an inverted U shape. The compressible surface covers are disposed over and form fitted over two descending arms of the undersides of each of the U shaped contact members. Such surface cover members, which may be made of waxed paper or disposable plastic or the like, are compressible so that they are form fitting over the arms of the inverted U shaped contact members, to isolate the contact members and therefore the seat portion itself, from the upper surface of the toilet bowl. Removably adjacent to the contact members, the compressible, disposable surface covers may, in the preferred embodiment, isolate the bottom underside of the toilet seat adaptor from contact with the top edge of the porcelain toilet bowl, upon which the adaptor sits when in use. Furthermore, the descending arms of the contact members wrap over and around the top edges of the toilet bowl, thereby also providing stability to keep the toilet seat adaptor upon the toilet bowl.

The invention itself will be best understood when a preferred embodiment of the invention is described with reference to the accompanying drawings.

BRIEF DESCRIPTION OF THE DRAWINGS

FIG. 1 is a perspective view of the toilet seat adaptor for the use of children and infants in accord with the teachings of the present invention, with the adaptor in the open position.

FIG. 2 is a front view of the device as shown in FIG. 1 in the up position.

FIG. 3 is a perspective view of the invention in a partially closed position.

FIG. 4 is a close up view of the hinge member of the device.

FIG. 5 is a perspective view of the device in a closed position within a carrier means.

FIG. 6 is a perspective view of the device in an open position with the bottom side up showing the elevated contact members.

FIG. 7 is a close up view of one of the contact members.

FIG. 7A is another close up view of the contact member.

FIG. 8 is a close up view of another version of the contact member.

FIG. 9 is a close up view of another version of the elevated contact member.

FIG. 10 is a partial sectional view of the device as shown in FIG. 8.

DESCRIPTION OF THE INVENTION

Figure 4A:
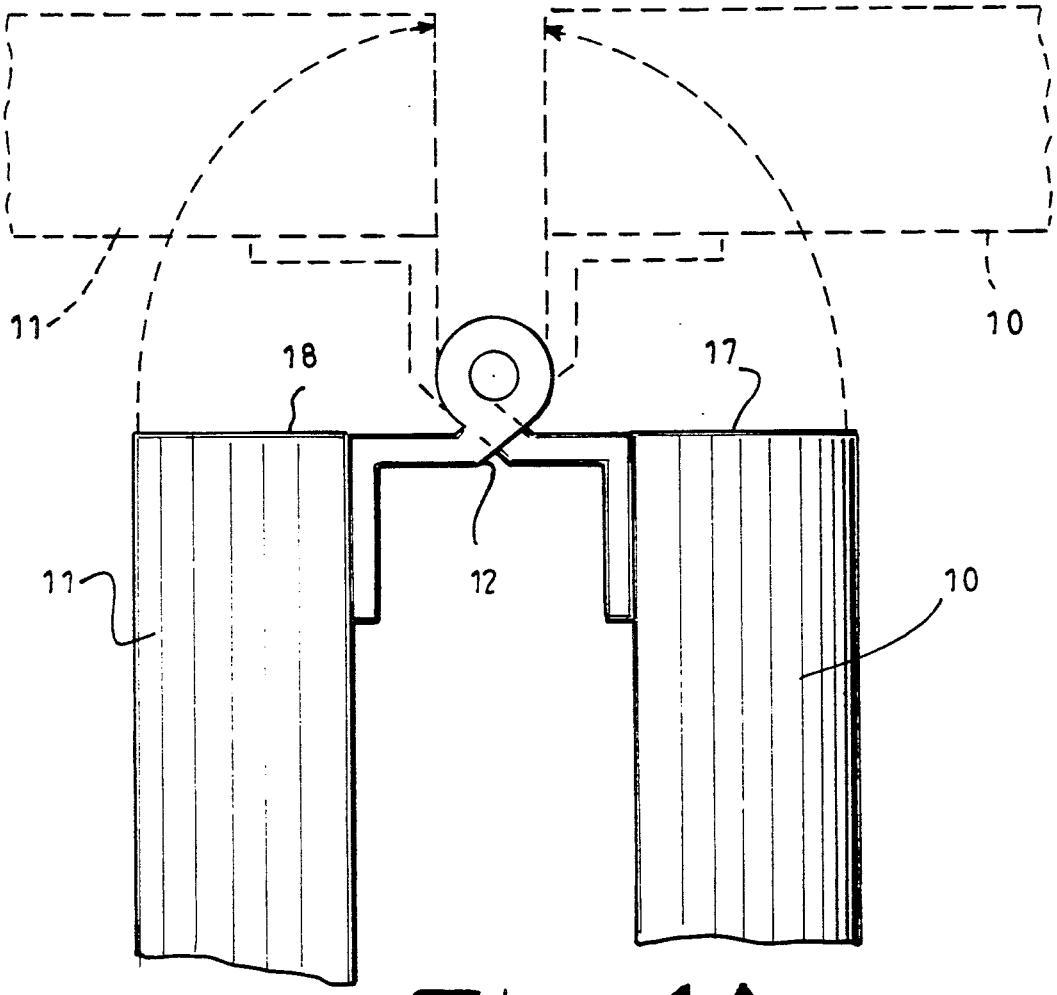
FIGS. 4A and 4B are close-up views of one embodiment of the hinge member as shown in FIG. 4.

Attention is directed to FIGS. 1 and 2 which shows the device in an operable position upon a toilet bowl. The adaptor 1 is placed upon the front end of toilet bowl 2 having seat 3. The device further has arcuate hinged panel members 10 and 11 in a mirror image of each other. The panels arcuately fan out from the proximal hinged end of each other to the distal end. The panels 10 and 11 pivot about hinged member 12 which joins the panels 10 and 11 to each other. When viewed from the front, left panel 10 has an elevated contact member 13 at its proximal end with respect to hinged member 12 and another elevated contact member 14 at the distal end. Right panel 11 has an elevated contact member 15 at the proximal end with respect to hinged member 12 and a second elevated contact member 16 at the distal end. Panels 10 and 11 fold together about hinged member 12 so that the panels meet in a parallel mirror image of each other, such that the distal ends of each panel 10 and 11 are adjacent to each other.

Figure 4B:
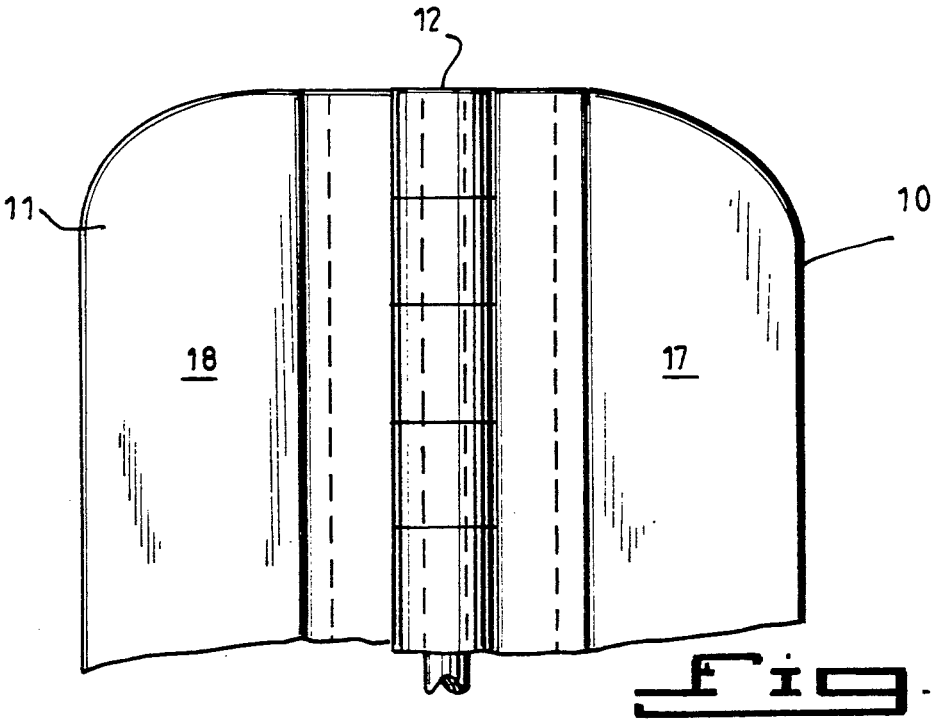

As shown in FIGS. 3,4 and 5, base 17 of panel 10 and base 18 of panel 11 are joined adjacent to each other about hinged member 12. Left side panel 10, when viewed from the underside with hinge 12 at the top, contains bottom side portion 20 in an arcuate plane, upon which contact members 15 and 16 are placed at the proximal and distal ends respectively. Right side panel 11 when viewed from its underside with hinge 12 at the top contains bottom side 19 upon which elevated contact members 13 and 14 are placed at the proximal and distal ends respectively.

When in use elevated contact members 13, 14, 15 and 16 isolate and elevate panels 10 and 11 from the surface of the toilet bowl 2, thereby providing for minimal surface contact and the lessening of the possibility of the transmission of bacterial and/or viral infestation upon the adaptor and the child user. Elevated contact members 13, 14, 15 and 16 also provide stability for panels 10 and 11 while resting upon, in an open position, toilet bowl 2.

Elevated contact members 13, 14, 15 and 16 as shown in FIG. 7 may comprise a cylindrical aggregation 30 of lift off disks 31 which are individually peeled and removed upon each use. A new aggregation of lift off disks may be applied upon the exhausting of the original supply of the disks 31.

In another embodiment as shown in FIG. 7A, disks 13, 14, 15 and 16 are cylindically shaped having top portion 31*a* upon which removable disks 32 are placed. After use disposable disk 32 is disposed of.

In the preferred embodiment as shown in FIGS. 8 and 10, the contact members comprise inverted U shape elevating members 40*a*, having base portions 44*a* attached to bottom sides 20 and 19 of panels 11 and 10 of the present invention, together with respective pairs of descending arms 42*a*,43*a* over which disposable surface cover members 41*a* are compressibly form-fitted. Typical disposable member 41*a* contains side walls 44 and 45, top wall 43 and rear wall 46 which are compressed over to accommodate the form-fitting of the disposable surface cover 41*a* upon the U shaped contact member 40*a*.

Similarly shaped contact members 40*a* are attached to bottom sides 20 and 19 of panels 11 and 10. The compressible surface covers 41*a* conform to the interior of respective pairs of descending arms 42*a*,43*a* of contact members 40*a*. The aforesaid pairs of descending arms descend downward from base portions 44*a* of contact members 40*a* and around the upper edge of toilet bowl 2, so that the toilet seat adaptor is isolated and elevated away from the upper surface of toilet bowl 2.

As shown in FIG. 10, by hugging the edge of toilet bowl 2, descending pairs of arms 42*a*,43*a* provide a stabilizing means to secure the toilet seat adaptor upon the top edge of toilet bowl 2.

In a further embodiment, contact member 50 comprises side walls 52 and 53 extended upward from base portion 54 from which side walls 52 and 53 elevate, together with disposable housing member 51 having side walls 55 and 56, which are removably fitted upon extending members 52 and 53 of contact member 50. Top portion 57 encloses contact member 50. After use disposable contact housing 51 is disposed of.

A preferred embodiment of the invention has been shown and described and several alternate structures have been mentioned. Other changes and modifications may be made as will become apparent to those skilled in the art, without departing from the invention as defined in the claims.

What is claimed is:

1. A toilet seat adaptor for the use of children and infants, said toilet seat adaptor having a pair of arcuate side panels, each side panel including a top surface and a bottom surface, each bottom surface having a plurality of elevated contact members thereon, said panels joined together by a common hinged member at one end, said panels being foldable to a closed position and unfoldable to a U-shaped configuration such tat said panels hingedly extend in a mirror image of each other, said contact members adapted to elevate said panels above an upper surface of a rim of a toilet bowl when said panels are unfolded and positioned thereon, the improvement comprising;

said contact members being substantially U-shaped having arm portions extending downward from a base portion secured to said bottom surface of said panel, said contact members being sized to receive said toilet bowl rim between said arm portions when said panels are positioned on said rim; and, means for temporarily isolating said elevated contact members from surface contact with said toilet bowl rim, said means including respective flexible surface covers removably covering said elevated contact members, said covers being substantially rectangular and having at least one open side to allow placement over said contact members, said removable surface covers being deformed when said panels are positioned on said rim to isolate said contact members from said rim.

2. The invention as in claim 1 wherein said descending arms of said contact members are perpendicular to the base portions of said contact members.

* * * * *